US005877615A

United States Patent [19]

Wang et al.

[11] Patent Number: 5,877,615

[45] Date of Patent: Mar. 2, 1999

[54] DYNAMIC INPUT REFERENCE VOLTAGE ADJUSTER

[75] Inventors: Min-Kun Wang, Hsin-Chu; Wen-Ping Cheng, Tao-Yuan; Der-Chwan Wu; Hui-Yi Cheng, both of Hsin-Chu, all of Taiwan

[73] Assignee: Utek Semiconductor Corporation, Hsinchu, Taiwan

[21] Appl. No.: 965,581

[22] Filed: Nov. 6, 1997

[51] Int. Cl.[6] ..... G05F 3/16

[52] U.S. Cl. ..... 323/313

[58] Field of Search ..... 323/312, 313, 323/314, 316, 281; 327/530, 535, 538, 539

[56] References Cited

U.S. PATENT DOCUMENTS

| | | | |
|---|---|---|---|
| 4,013,938 | 3/1977 | McCoy | 363/56 |
| 4,059,793 | 11/1977 | Ahmed | 323/313 |
| 4,454,467 | 6/1984 | Sakaguchi | 323/313 |
| 4,553,083 | 11/1985 | Yang | 323/313 |
| 4,658,205 | 4/1987 | Yamada | 323/313 |
| 5,159,260 | 10/1992 | Yoh et al. | 323/313 |
| 5,612,613 | 3/1997 | Dutt et al. | 323/314 |
| 5,686,823 | 11/1997 | Rapp | 323/313 |

*Primary Examiner*—Adolf Berhane
*Attorney, Agent, or Firm*—Raymond Sun

[57] ABSTRACT

A circuit and a method for generating modified reference voltages are provided. The reference voltages are modified dependent upon the level of electrical signals received. A series of electrical signals is provided to a reference voltage adjuster. The reference voltage adjuster stores a signal representing either a previous maximum or minimum signal value, and also stores a signal representing a present signal from the series of electrical signals. The reference voltage adjuster then determines the existence of a new maximum or minimum signal value. Upon the determination of the existence of a new maximum or minimum signal value, the average of the new maximum or minimum signal and the previous maximum or minimum signal value is determined. The signal representing the average of the new maximum or minimum signal and the previous maximum or minimum signal value is then provided to a comparator as the new reference voltage.

21 Claims, 6 Drawing Sheets

DYNAMIC INPUT REFERENCE VOLTAGE ADJUSTER

BACKGROUND OF THE INVENTION

1. Field of the Invention

The present invention relates to integrated circuits, and in particular, to integrated circuits which provide for the dynamic adjustment of reference voltages.

2. Description of the Prior Art

Computer mice are commonly used for data input and cursor positioning. A conventional computer mouse has a rolling ball that is housed within the housing of a computer mouse. The ball is rolled as the mouse is moved by a user on a mouse pad or flat surface. The ball is contacted by at least two encoder wheel assemblies, one encoder wheel assembly for the X-axis and one encoder wheel assembly for the Y-axis. Each encoder wheel assembly includes a shaft and an encoder wheel having a plurality of slits. A light-emitting element (such as an LED) and a light-receiving element (such as a phototransistor) are positioned on opposite sides of each encoder wheel. Rotation of the ball causes the shafts to rotate, thereby rotating the encoder wheels. As each encoder wheel rotates, its corresponding phototransistor receives pulses of light from the corresponding LED if the LED and the phototransistor are aligned with a slit, otherwise no light is received by the phototransistor. The phototransistor converts the received light pulses into electrical signals.

The electrical signals generated by each phototransistor will assume a generally sinusoidal pattern, as illustrated in FIG. 1. The sine wave represents the passage of one slit through the light path of the LED. For example, at the beginning, represented by the point A1, only a small part of the slit is in the light path of the LED, so only a small amount of light is received by the phototransistor and a small electrical signal is produced. As a larger portion of the slit is in the light path of the LED, increasingly more light is received by the phototransistor and a proportionally larger electrical signal is produced (represented by the point A2 in FIG. 1) until the entire slit is in the light path of the LED, when the maximum amount of light is received by the phototransistor and the largest electrical signal is produced. This point is represented by the maximum or peak "PEAK" in the sine wave. After reaching this PEAK, the portion of the slit which is in the light path of the LED begins to decrease, thereby reducing the amount of light received by the phototransistor so that a decreasing electrical signal is produced. This is represented by the point B1 in FIG. 1. This continues until only a small part of the slit is again in the light path of the LED, during which only a small amount of light is received by the phototransistor and another small electrical signal is produced. This point is represented by point B2 in FIG. 1. Finally, the minimum or valley "VALLEY" in the sine wave represents the point when the light path between the LED and the phototransistor is completely blocked. The same cycle is then repeated for the other slits in the encoder wheel.

Thus, the point "PEAK" represents the instant in the sine wave when a slit is completely open, and the point "VALLEY" represents the time when the light path between the LED and the phototransistor is completely blocked by the encoder wheel. When the light path is completely blocked, the voltage V should ideally be equal to zero. However, the phototransistor will typically still maintain a very low leakage current which is due to the possibility that the environment of the phototransistor is not completely dark, or that minimal light may still have passed through the slit.

The continuous pulse signals generated by each phototransistor is compared with a fixed reference voltage to determine whether the phototransistor is conducted (i.e., light passes through the slit) or cut-off (i.e., no light passes through the slit). After the comparison, the pulse signals from these phototransistors are processed by a logic controller to represent the distance and orientation (i.e., X and Y orientations) of the movement of the mouse.

FIG. 2 illustrates a conventional reference voltage generator that is used for generating a reference voltage. The output of phototransistor PT is coupled to a comparator 10 to determine whether the phototransistor PT is conducted or cut-off, based on a fixed reference voltage Vref. The Vref is normally selected to be the mid-point of the PEAK and the VALLEY generated by the phototransistor PT. If an input voltage from the phototransistor PT is higher than Vref, the phototransistor PT is considered to be conducted, otherwise it is considered to be cut-off.

In the conventional reference voltage generator, Vref is predetermined and fixed. However, a fixed Vref suffers from the drawback that the input voltage from phototransistor PT cannot be correctly detected if the input voltage is below or above a predetermined range associated with Vref. For example, using a 10 kilo-ohm input resistance, if an input sine wave current is between 0–500 microamps, which has an input voltage of 0–5 V, the Vref can be fixed at 2.5 V. An input which is below the value of Vref, such as an input of 0–200 microamps (which has an input voltage of 0–2 V ), may not be considered to be a cut-off signal. Similarly, an input which is above the value of Vref, such as an input of 300–500 microamps (which has an input voltage of 3–5 V), may not be considered to be a conduction signal either. As a result, input signals are often incorrectly bypassed by the comparator 10. This problem results in erroneous distance and orientation measurements for the mouse, making usage of the mouse difficult and frustrating.

Thus, there still remains a need for a reference voltage adjuster which overcomes the drawbacks of the conventional reference voltage generators, and which provides for accurate processing of the input signals received from the phototransistors.

SUMMARY OF THE DISCLOSURE

It is therefore an object of the present invention to provide a reference voltage adjuster which overcomes the problems encountered by the prior art reference voltage generators.

It is another object of the present invention to provide a dynamic reference voltage adjuster which continuously calculates and provides accurate reference voltages which are consistent with the levels of the electrical signals from the phototransistors.

It is a further object of the present invention to provide a reference voltage adjuster which accurately determines the mid-point of the maximum (PEAK) and minimum (VALLEY) values of the electrical signals from the phototransistors.

It is yet a further object of the present invention to provide a reference voltage adjuster which accurately determines the mid-point of the maximum (PEAK) and minimum (VALLEY) values of the electrical signals from both the X-axis phototransistor and the Y-axis phototransistor.

In order to accomplish the objects of the present invention, the present invention provides a reference voltage adjuster and a method for generating modified reference voltages that are dependent upon the level of electrical signals received. A series of electrical signals is provided to a reference voltage adjuster according to the present invention. The reference voltage adjuster stores a signal representing either a previous maximum or minimum signal value, and also stores a signal representing a present signal from the series of electrical signals. The reference voltage adjuster then determines the existence of a new maximum or minimum signal value. Upon the determination of the existence of a new maximum or minimum signal value, the average of the new maximum or minimum signal and the previous maximum or minimum signal value is determined.

The reference voltage adjuster of the present invention determines the existence of a new maximum or minimum signal value by first comparing the present signal with a signal immediately preceding the present signal, then generating a signal which is representative of the present signal being "greater than", "less than" or "equal to" the immediately preceding signal, and then recognizing the existence of one of the following patterns of three consecutive signals: ("greater than", "greater than", "less than") or ("less than", "less than", "greater than").

The reference voltage adjuster of the present invention determines the average of the new maximum or minimum signal and the previous maximum or minimum signal value by summing the present signal and the previous maximum or minimum signal value, then dividing the sum of the present signal and the previous maximum or minimum signal value. The signal representing the average of the new maximum or minimum signal and the previous maximum or minimum signal value is then provided to a comparator as the new reference voltage.

The reference voltage adjuster according the present invention can also be multiplexed to provide dynamically modified reference voltages for two or more series of electrical signals. The reference voltage adjuster processes, in an alternating sequence, the electrical signals received from the different series of electrical signals, to continuously determine new reference voltages for each series of electrical signals.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known circuits and components are omitted so as to not obscure the description of the present invention with unnecessary detail.

The present invention provides a dynamic reference voltage adjuster circuit which generates a dynamically changing reference voltage which is the mid-point of the maximum (PEAK) and minimum (VALLEY) values of the electrical signals from a phototransistor. The reference voltage adjuster circuit of the present invention stores the value of the previous maximum (PEAK) or minimum (VALLEY) in a latch, and then proceeds to ascertain the next minimum (VALLEY) or maximum (PEAK), respectively. Upon locating the next minimum (VALLEY) or maximum (PEAK), the circuit adds the previous maximum (PEAK) or minimum (VALLEY) with the next minimum (VALLEY) or maximum (PEAK), respectively, and divides the sum by two to obtain the average or mid-point. This mid-point value is then used as the new reference voltage until the next reference voltage is generated.

Figure 1:
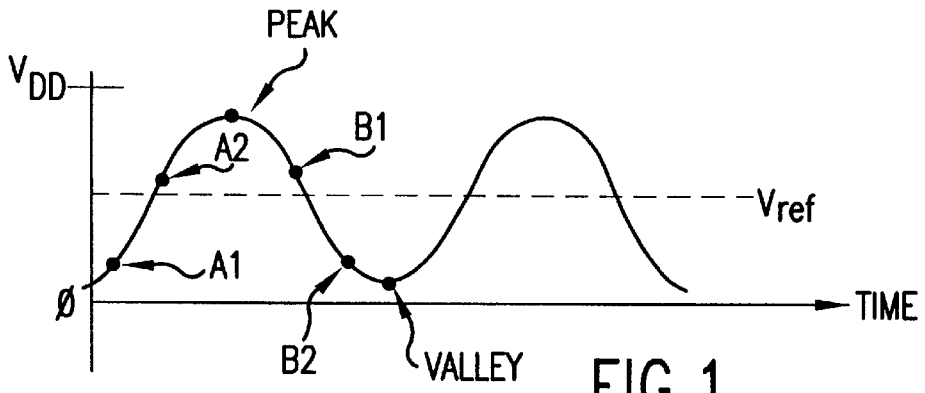
FIG. 1 illustrates the pattern assumed by the electrical signals generated by a phototransistor used in a conventional mouse.
Figure 2:
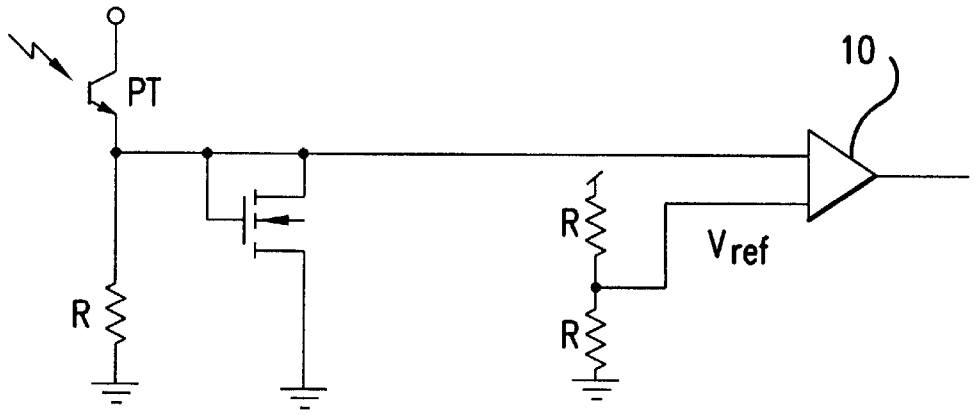
FIG.2 (PRIOR ART)
FIG. 2 is a simplified schematic diagram of a conventional detector.
Figure 3:
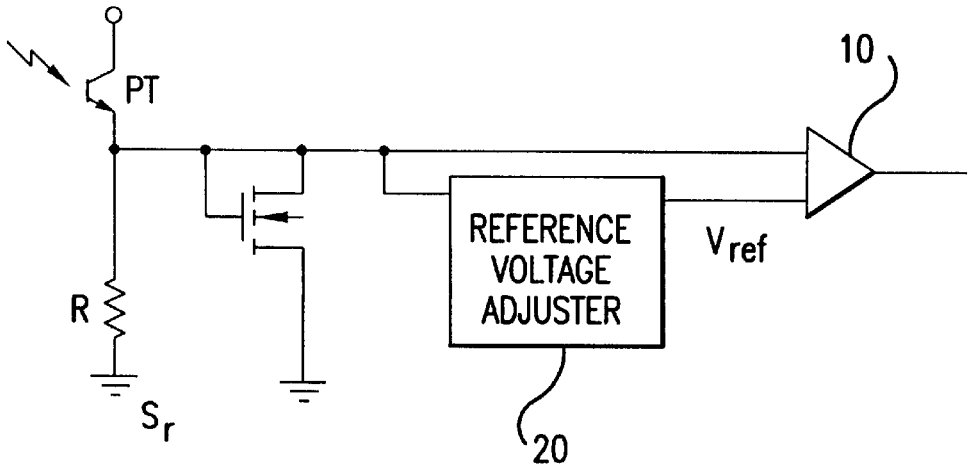
FIG. 3 is a simplified schematic diagram of a reference voltage generator according to one embodiment of the present invention.

FIG. 3 is a general schematic diagram of one embodiment of the present invention. A phototransistor PT has an emitter electrode coupled to a resistor R, which is in turn coupled to ground. The emitter electrode of the phototransistor PT is also coupled to a first input of a comparator 10. An NMOS is coupled to the connection between the phototransistor PT and the comparator 10 and functions to stabilize the value of the current in the circuit. All the elements described hereinabove are found in conventional reference voltage generator circuits, and shall not be described in further detail. The present invention lies in the provision of a reference voltage adjuster 20 according to the present invention, which is coupled to a second input of the comparator 10. The reference voltage adjuster 20 according to the present invention operates to adjust the reference voltage Vref applied to the comparator 10 by providing a reference voltage Vref that is consistently at the mid-point of the PEAK and the VALLEY generated by the phototransistor PT. As a result, the comparator 10 will be able to accurately determine the actual conduction and cut-off states of the phototransistor PT.

Figure 4:
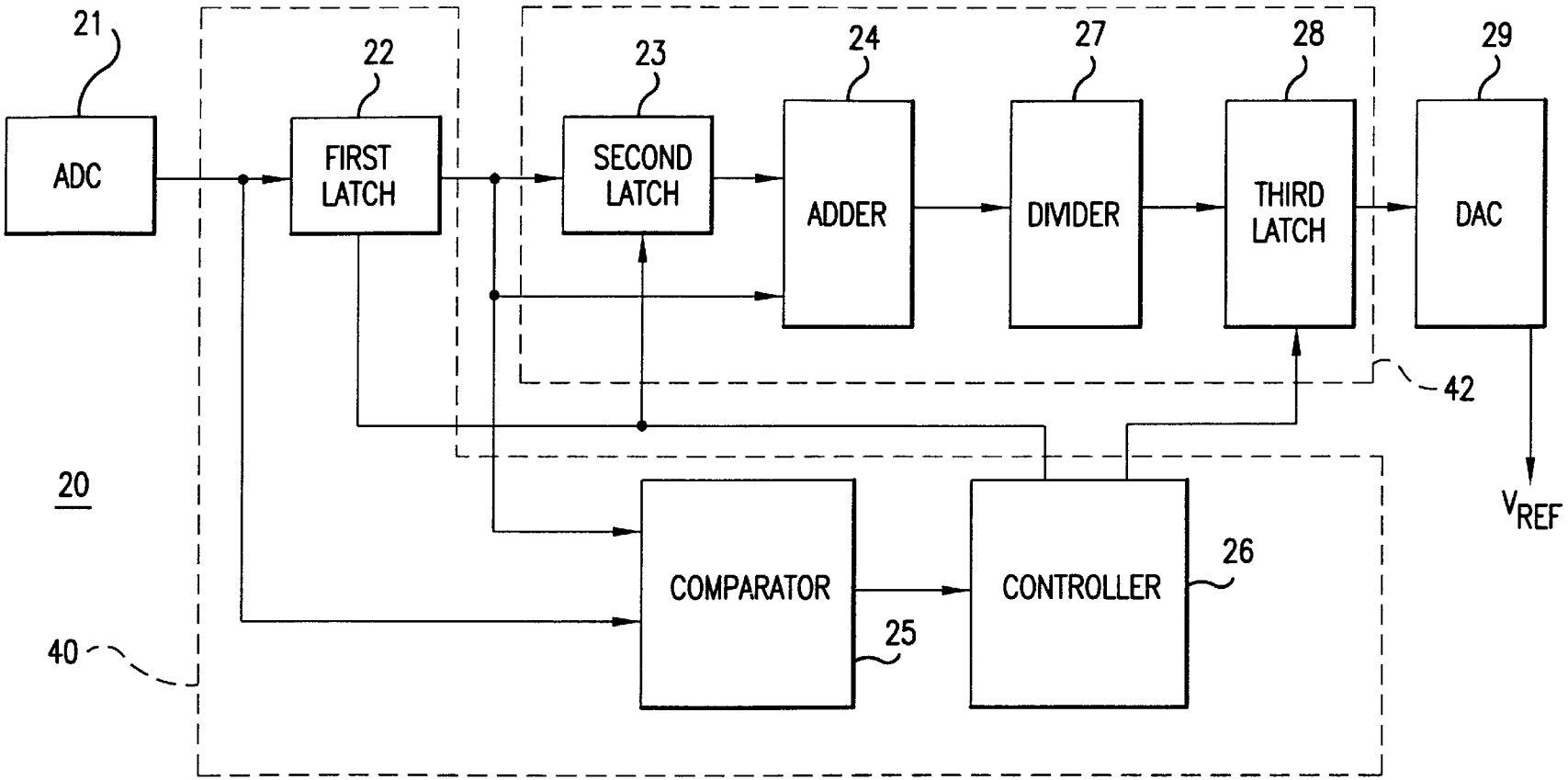
FIG. 4 is a schematic diagram of the reference voltage adjuster circuit of FIG. 3.

Referring to FIG. 4, the reference voltage adjuster circuit 20 includes an analog-to-digital (A/D) converter 21 which converts the analog electrical signals received from the phototransistor PT into digital signals for processing. At this time, a first latch 22 currently holds the digital value of the previous electrical signal from phototransistor PT, and a second latch 23 currently holds the digital value of the previous maximum (PEAK) or minimum (VALLEY) electrical signal. The present digital signals output from the A/D converter 21 are provided to the first latch 22 and a comparator 25. The comparator 25 also has an input coupled to the first latch 22, and compares the values of the present signal (from the A/D converter 21) with the previous signal (from the first latch 22). The three possible comparison results are that the present signal is either "greater than" (>), "less than" (<), or "equal to" (=) the previous signal. The comparison results are provided to an input of a controller 26. The controller 26 also has outputs connected to the first latch 22, the second latch 23, and a third latch 28.

The controller 26 then processes the comparison results received. If the results of three consecutive comparisons are either (>><) or (<<>), the controller 26 recognizes that the electrical signal from the phototransistor PT has reached and passed either a PEAK or a VALLEY, respectively, in the sine wave. For example, if two consecutive "greater than" signals are received, it means that the electrical signal from the phototransistor PT is still increasing. Therefore, a subsequent "less than" signal would mean that the electrical signal from the phototransistor PT has passed the PEAK and is now decreasing along the sine wave. Similarly, if two consecutive "less than" signals are received, it means that the electrical signal from the phototransistor PT is still decreasing. Therefore, a subsequent "greater than" signal would mean that the electrical signal from the phototransistor PT has passed the VALLEY and is now increasing along the sine wave. Thus, the purpose of obtaining either (>><) or (<<>) as the result of three consecutive comparisons is to locate either a maximum or a minimum value for the electrical signal from the phototransistor PT.

Therefore, if the results of three consecutive comparisons are either (>><) or (<<>), the controller 26 will open the third latch 28, and will cause the first latch 22 and the second latch 23 to provide their values to an adder 24 (such as a full adder) which will add the two values. These two values essentially represent a maximum (PEAK) and a minimum (VALLEY) value. The added value is then provided to a divider 27 (which can be a shifter or other conventional dividing circuit), which divides the value by two to provide the average or mid-point value, which is then provided to the third latch 28 and stored therein. The mid-point value in third latch 28 represents the ideal reference voltage for the present electrical signals, and is then provided to a digitial-to-analog (D/A) converter 29, which converts the digital signal back into an analog signal representative of the reference voltage Vref. The reference voltage Vref is provided to comparator 10 in FIG. 3.

After a new maximum (PEAK) or minimum (VALLEY) electrical signal has been determined and a new mid-point located, as described above, the controller 26 causes the first latch 22 to provide its existing value, which represents the new maximum (PEAK) or minimum (VALLEY) electrical signal from phototransistor PT, to the second latch 23 to be stored therein. The process described above is then repeated to locate the next maximum (PEAK) or minimum (VALLEY) electrical signal from phototransistor PT, at which time a potential new mid-point value is located and provided to the comparator 10 as the new reference voltage Vref. This process is continuously repeated to dynamically adjust the reference voltage Vref provided to comparator 10, thereby ensuring that the input signals received from the phototransistor PT are accurately processed and accurately represent the movements of the mouse.

In essence, as illustrated in FIG. 4, the first latch 22, the comparator 25 and the controller 26 operate as a locater circuit 40 to locate the maximum (PEAK) and minimum (VALLEY) values, while the second latch 23, the adder 24, the divider 27 and the third latch 28 operate as an averaging circuit 42 to determine the average or mid-point of the previous maximum (PEAK) or minimum (VALLEY) with the next minimum (VALLEY) or maximum (PEAK), respectively.

Figure 5A:
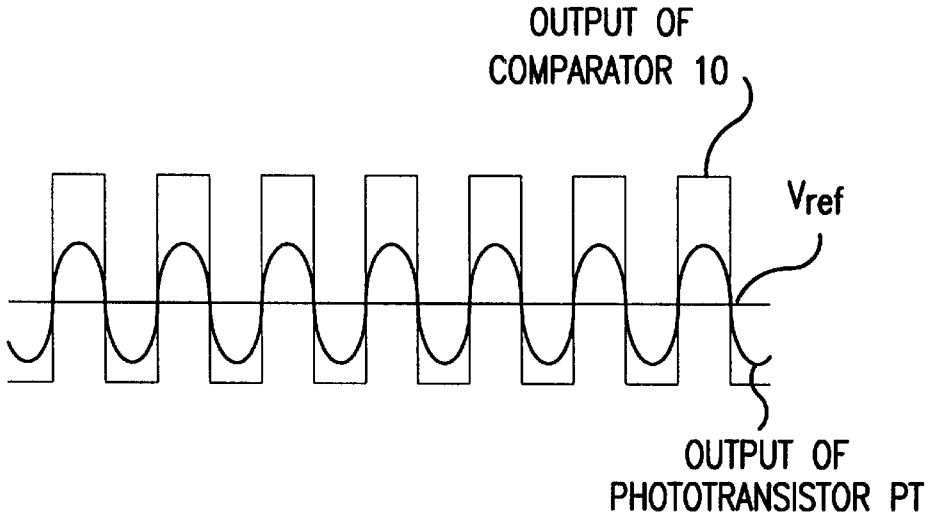
FIG. 5A illustrates how the reference voltage adjuster circuit of FIG. 4 adjusts to a larger electrical signal output by the phototransistor.
Figure 5B:
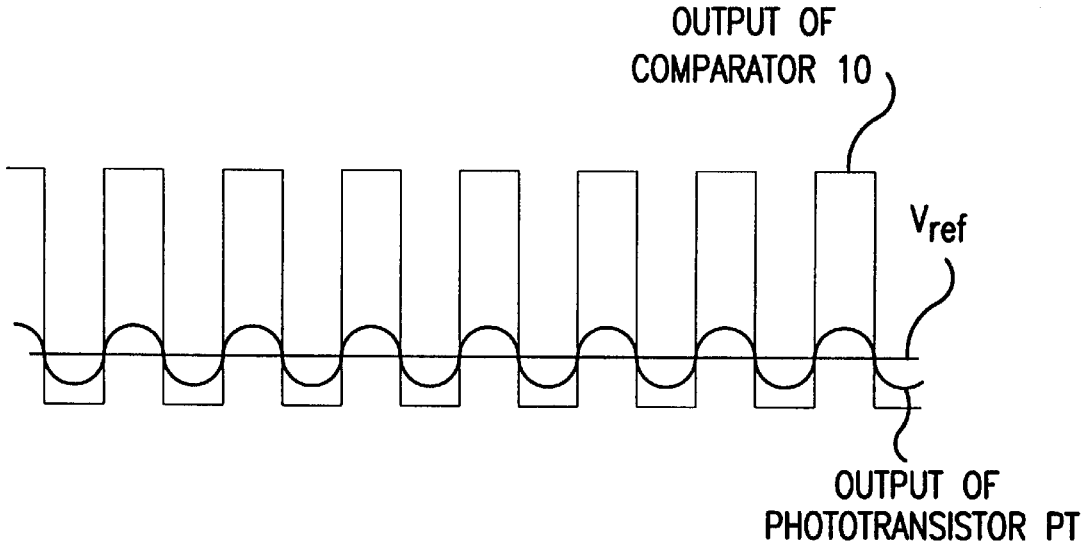
FIG. 5B illustrates how the reference voltage adjuster circuit of FIG. 4 adjusts to a smaller electrical signal output by the phototransistor.

FIGS. 5A and 5B illustrate how the reference voltage adjuster circuit 20 of the present invention adjusts to the electrical signals output by the phototransistor PT. Referring to FIG. 5A, if the electrical signals output by the phototransistor PT are larger, the reference voltage Vref generated by the reference voltage adjuster circuit 20 will be at about the mid-point of the maximum and minimum signal levels of the phototransistor PT. Similarly, referring to FIG. 5B, if the electrical signals output by the phototransistor PT are smaller, the reference voltage Vref generated by the reference voltage adjuster circuit 20 will also be at about the mid-point of the maximum and minimum signal levels of the phototransistor PT. Thus, it can be seen that the output of the comparator 10 will more accurately reflect the true conduction and cut-off states of the phototransistor PT.

The foregoing description has been simplified to more clearly illustrate the general principles of the present invention. However, an actual mouse has at least two phototransistors, one for the X-axis and another for the Y-axis. Therefore, the reference voltage adjuster circuit 20 can be modified to process electrical signals received from both the X-axis phototransistor PTX and the Y-axis phototransistor PTY.

Figure 6:
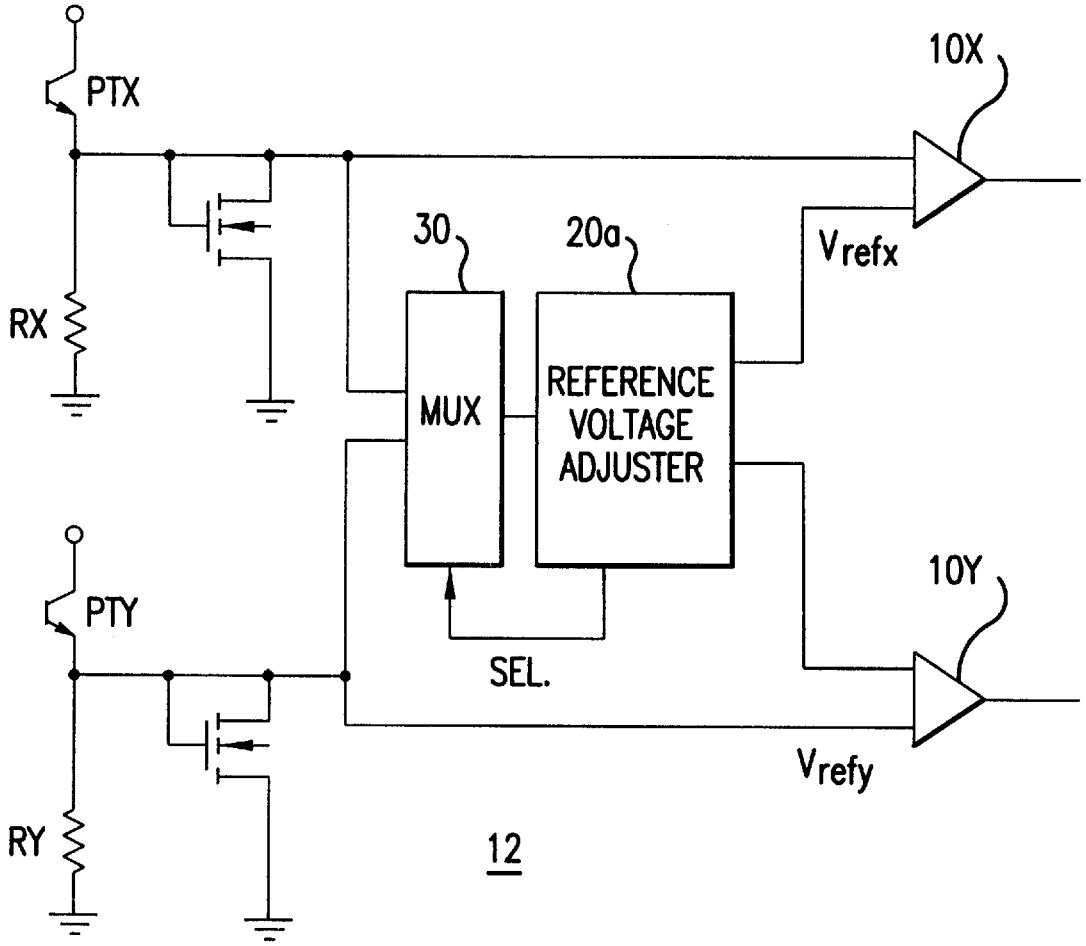
FIG. 6 is a simplified schematic diagram illustrating the use of the reference voltage adjuster circuit of the present invention to process electrical signals received from X-axis and Y-axis phototransistors.

Referring to FIG. 6, the reference voltage generator application circuit 12 includes two phototransistors, an X-axis phototransistor PTX and a Y-axis phototransistor PTY. Each phototransistor PTX and PTY has an emitter electrode coupled to a separate resistor RX and RY, respectively, each of which is in turn coupled to ground. The emitter electrode of each phototransistor PTX and PTY is also coupled to a first input of a separate comparator 10X or 10Y, and an input of a multiplexer 30. An NMOS is coupled to the connection between each phototransistor PTX and PTY and the corresponding comparator 10X and 10Y, respectively, and functions to stabilize the values of the currents in the circuit 12.

Figure 7:
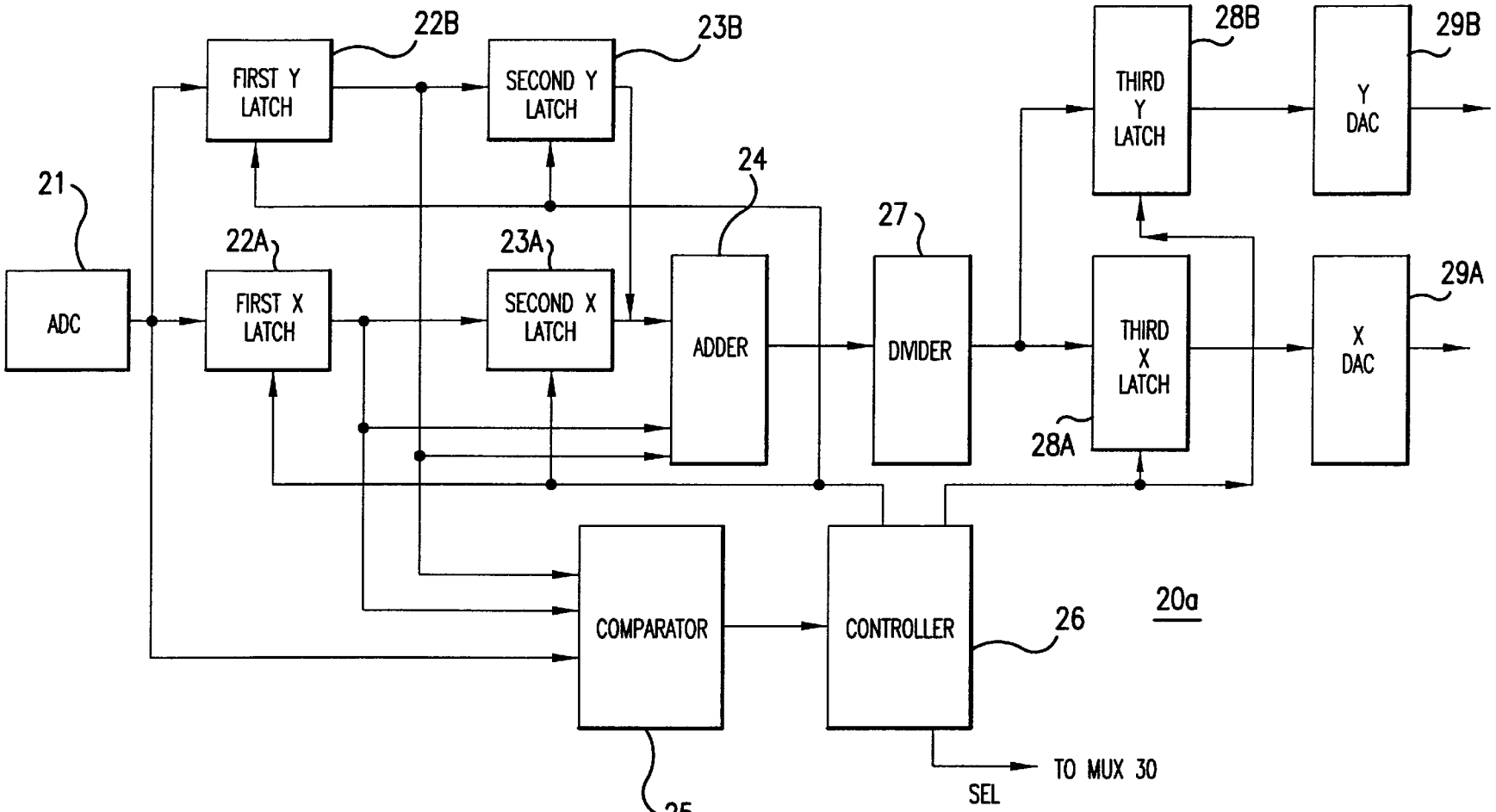
FIG. 7 is a schematic diagram illustrating the reference voltage adjuster circuit of FIG. 6.

Reference voltage generator circuit 12 includes a multiplexer 30 and a reference voltage adjuster 20*a*. Reference voltage generator circuit 12 allows the present invention to be expanded to process multiple signals. The multiplexer 30 functions to selectively pass the electrical signals from the two phototransistors PTX and PTY to the reference voltage adjuster circuit 20*a*. Referring to FIG. 7, the reference voltage adjuster circuit 20*a* is essentially the same as reference voltage adjuster circuit 20 except that each of the latches 22, 23 and 28 are now replaced by separate X and Y latches. Thus, there are now provided a first X latch 22A, a first Y latch 22B, a second X latch 23A, a second Y latch 23B, a third X latch 28A and a third Y latch 28B. In addition, the D/A converter 29 is now replaced by an X D/A converter 29A and a Y D/A converter 29B. However, a common A/D converter 21, adder 24, comparator 25, controller 26 and divider 27 are provided for processing both the X and Y phototransistor signals.

The operation of the reference voltage adjuster circuit 20*a* is similar to the operation of the reference voltage adjuster circuit 20, except that the circuit 20*a* is multiplexed by the multiplexer 30 to process the X and Y signals in an alternative sequential manner. In particular, the controller 26 is designed to alternatively control the computation of the X and the Y reference voltages, and generates a select signal SEL to the multiplexer 30 to instruct the multiplexer 30 to pass the corresponding X or Y electrical signals from the respective phototransistor PTX or PTY.

The operation of the circuit 20*a* can be described as follows. First, the multiplexer 30 passes through the corresponding X or Y electrical signals from the respective phototransistor PTX or PTY, depending on the SEL signal received from the controller 26. The A/D converter 21 converts the analog electrical signal (X or Y) received from the phototransistors PTX and PTY into a digital signal for processing. At this time, the first X and Y latches 22A and 22B currently hold the digital values of the previous X and Y electrical signals, respectively, from the phototransistors PTX and PTY, respectively, and the second latches 23A and 23B currently hold the digital value of the previous maximum (PEAK) or minimum (VALLEY) X and Y electrical signals, respectively. Assuming that the present signal output from the A/D converter 21 is an X-axis signal from phototransistor PTX, it is provided to the first X latch 22A and the comparator 25. The comparator 25 also has an input coupled to the first X latch 22A, and compares the value of the present X-axis signal (from the A/D converter 21) with the previous signal (from the first X latch 22A). The three possible comparison results are that the present X-axis signal is either "greater than" (>), "less than" (<), or "equal to" (=) the previous X-axis signal. The comparison results are provided to an input of the controller 26. The controller 26 also has outputs connected to the first X latch 22A, the second X latch 23A, and the third X latch 28A.

The controller 26 then processes the comparison results received. If the results of three consecutive X-axis comparisons are either (>><) or (<<>), the controller 26 recognizes that the electrical signal from the phototransistor PTX has reached and passed either a PEAK or a VALLEY in the sine wave. At this time, the controller 26 will open the third X latch 28A, and will cause the first X latch 22A and the second X latch 23A to provide their values to the adder 24 which will add the two X values from the first and second X latches 22A and 23A. Each of these two values essentially represent a maximum (PEAK) and a minimum (VALLEY) value for each of the X phototransistor PTX. The added value is then provided to the divider 27, which divides the value by two to provide the average or mid-point value. The mid-point value is then provided separately to the third X latch 28A and stored therein. The mid-point value in the third X latch 28A represents the ideal reference voltage Vrefx for the X phototransistor PTX, and is provided to the X D/A converter 29A, which converts the digital X-axis signal back into an analog signal representative of the reference voltage Vrefx. The reference voltage Vrefx is then provided to the comparator 10X in FIG. 6.

After a new maximum (PEAK) or minimum (VALLEY) electrical signal has been determined and a new mid-point located for the X phototransistor PTX, as described above, the controller 26 causes the first X latch 22A to provide its existing value, which represents the new maximum (PEAK) or minimum (VALLEY) electrical signal from the phototransistor PTX, to the second X latch 23A to be stored therein.

At this time, the SEL signal from the controller 26 will now instruct the multiplexer 30 pass the Y-axis electrical signal from phototransistor PTY. The circuit 20*a* will now process Y-axis electrical signal in the same manner described above for the X-axis electrical signal. In particular, the Y-axis signal is provided to the first Y latch 22B and the comparator 25. The comparator 25 also has an input coupled to the first Y latch 22B, and compares the value of the present Y-axis signal (from the A/D converter 21) with the previous signal (from the first Y latch 22B). The three possible comparison results are that the present Y-axis signal is either "greater than" (>), "less than" (<), or "equal to" (=) the previous Y-axis signal. The comparison results are provided to an input of the controller 26. The controller 26 also has outputs connected to the first Y latch 22B, the second Y latch 23B, and the third Y latch 28B.

The controller 26 then processes the comparison results received. If the results of three consecutive Y-axis comparisons are either (>><) or (<<>), the controller 26 recognizes that the electrical signal from the phototransistor PTY has reached and passed either a PEAK or a VALLEY in the sine wave. At this time, the controller 26 will open the third Y latch 28B, and will cause the first Y latch 22B and the second Y latch 23B to provide their values to the adder 24 which will add the two Y values from the first and second Y latches 22B and 23B. Each of these two values essentially represent a maximum (PEAK) and a minimum (VALLEY) value for each of the Y phototransistor PTY. The added value is then provided to the divider 27, which divides the value by two to provide the average or mid-point value. The mid-point value is then provided separately to the third Y latch 28B and stored therein. The mid-point value in the third Y latch 28B represents the ideal reference voltage Vrefy for the Y phototransistor PTY, and is provided to the Y D/A converter 29B, which converts the digital Y-axis signal back into an analog signal representative of the reference voltage Vrefy. The reference voltage Vrefy is then provided to the comparator 10Y in FIG. 6.

After a new maximum (PEAK) or minimum (VALLEY) electrical signal has been determined and a new mid-point located for the Y phototransistor PTY, as described above, the controller 26 causes the first Y latch 22B to provide its existing value, which represents the new maximum (PEAK) or minimum (VALLEY) electrical signal from the phototransistor PTY, to the second Y latch 23B to be stored therein.

The process described above is then repeated in an alternative sequential manner to locate the next maximum (PEAK) or minimum (VALLEY) electrical signal from phototransistor PTX, and then to locate the next maximum (PEAK) or minimum (VALLEY) electrical signal from phototransistor PTY, and so on, to dynamically adjust the reference voltages Vrefx and Vrefy provided to comparators 10X and 10Y, thereby ensuring that the input signals received from the phototransistors PTX and PTY are accurately processed and accurately represent the movements of the mouse.

Figure 8:
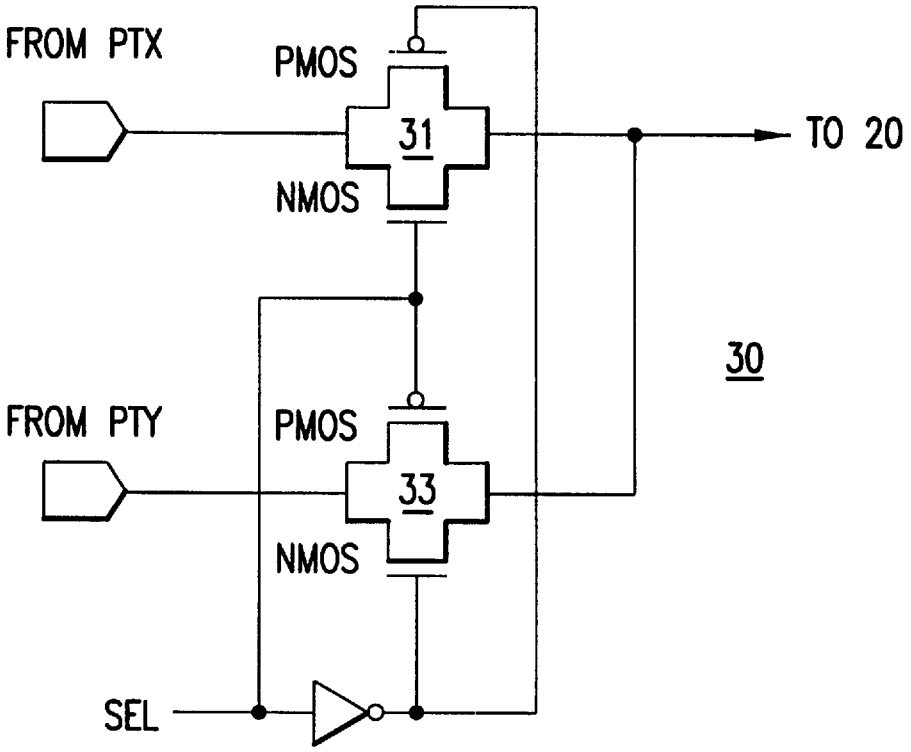
FIG. 8 is a schematic diagram of the multiplexer of FIG. 6.

FIG. 8 is a schematic diagram of the multiplexer 30. The multiplexer 30 is a conventional multiplexer that is used for analog signals. The multiplexer 30 has a pair of transmission gates 31 and 33, each coupled to one of the phototransistors PTX or PTY. The transmission gates 31 and 33 are selectively switched on by the SEL signal from the controller 26 to pass the desired X or Y axis signal to the circuit 20*a*. Each transmission gate 31 and 33 consists of a pair of NMOS and PMOS acting as an analog switch.

It is also possible to further modify the circuits shown in FIGS. 6–8 to multiplex more than two series of electrical signals. To do so, an additional set of a first latch 22, a second latch 23, a third latch 28, and a D/A converter 29 is provided for each additional series of electrical signals. The multiplexer 30 will be provided with an additional transmission gate for each additional series of electrical signals, and is operated to multiplex three or more series of electrical signals in the manner described above. Again, a common A/D converter 21, adder 24, comparator 25, controller 26 and divider 27 is sufficient for processing the plurality of series of phototransistor signals. Thus, by providing one reference voltage adjuster of the present invention to provide dynamically modified reference voltages for a plurality of series of phototransistor signals, it is possible to reduce the complexity of the circuit, thereby reducing the overall cost to the consumer.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A reference voltage adjuster for generating modified reference voltages that are dependent upon the level of electrical signals received, comprising:

a source of electrical signals;

a first latch coupled to the source for storing a signal representing the present signal received from the source;

a comparator having a first input coupled to the source of electrical signal and a second input coupled to the first latch;

a second latch for storing a signal representing either a previous maximum signal value or a previous minimum signal value;

an adder having a first input coupled to the first latch and a second input coupled to the second latch for summing the values of the signals in the first and second latches;

a divider coupled to the adder for dividing the summed values to produce an output;

a third latch coupled to the divider for storing the output received from the divider which represents a modified reference voltage; and a controller having outputs coupled to the first, second and third latches, the controller responsive to an output from the comparator for determining the existence of a new maximum or minimum signal value, and upon the determination of the existence of a new maximum or minimum signal value, causing the values retained in the first and second latches to be provided to the adder, and opening the third latch to receive the modified reference voltage.

2. The reference voltage generator of claim 1, further including an analog-to-digital converter coupled to the source.

3. The reference voltage generator of claim 1, further including a digital-to-analog converter coupled to the third latch.

4. The reference voltage generator of claim 1, wherein the comparator generates a signal which is representative of the present signal being "greater than", "less than" or "equal to" a signal immediately preceding the present signal.

5. The reference voltage generator of claim 4, wherein the controller determines the existence of a new maximum or minimum signal value by recognizing the existence of one of the following patterns of three consecutive signals from the comparator: ("greater than", "greater than", "less than") or ("less than", "less than", "greater than").

6. A reference voltage adjuster for generating modified reference voltages that are dependent upon the level of electrical signals received, comprising:

means for receiving a series of electrical signals;

first means coupled to the receiving means for storing a signal representing the present signal from the series of electrical signals;

second means coupled to the first storing means for storing a signal representing either a previous maximum or minimum signal value;

means responsive to the receiving means for locating either a new maximum signal value or a new minimum signal value; and means responsive to the locating means for determining the average of the new maximum or minimum signal and the previous maximum or minimum signal value.

7. The reference voltage generator of claim 6, wherein the locating means includes:

a comparator which generates a signal which is representative of the present signal being "greater than", "less than" or "equal to" a signal immediately preceding the present signal; and a controller which determines the existence of a new maximum or minimum signal value by recognizing the existence of one of the following patterns of three consecutive signals from the comparator: ("greater than", "greater than", "less than") or ("less than", "less than", "greater than").

8. The reference voltage generator of claim 6, wherein the means for determining the average includes:

an adder having a first input coupled to the first storing means and a second input coupled to the second storing means for summing the values of the present signal and the signal representing either a previous maximum or minimum signal value;

a divider coupled to the adder for dividing the summed values and producing an output; and a third latch coupled to the divider for storing the output received from the divider which represents a modified reference voltage.

9. A method for generating modified reference voltages that are dependent upon the level of electrical signals received, comprising the steps of:

a. providing a series of electrical signals;

b. storing a signal representing either a previous maximum or minimum signal value;

c. storing a signal representing a present signal from the series of electrical signals;

d. determining the existence of a new maximum or minimum signal value; and e. upon the determination of the existence of a new maximum or minimum signal value, determining the average of the new maximum or minimum signal and the previous maximum or minimum signal value.

10. The method of claim 9, wherein step (d) includes the steps of:

(d1) comparing the present signal with a signal immediately preceding the present signal;

(d2) generating a signal which is representative of the present signal being "greater than", "less than" or "equal to" the immediately preceding signal; and (d3) recognizing the existence of one of the following patterns of three consecutive signals: ("greater than", "greater than", "less than") or ("less than", "less than", "greater than").

11. The method of claim 9, wherein step (e) includes the steps of:

(e1) summing the present signal and the previous maximum or minimum signal value; and (e2) dividing the sum of the present signal and the previous maximum or minimum signal value.

12. The method of claim 9, wherein step (a) includes the steps of:

(a1) converting the electrical signals to digital signals.

13. The method of claim 9, wherein step (e) includes the steps of:

(e3) converting the signal representing the average of the new maximum or minimum signal and the previous maximum or minimum signal value to an analog signal.

14. The method of claim 9, wherein step (e) includes the steps of:

(e4) providing the signal representing the average of the new maximum or minimum signal and the previous maximum or minimum signal value to a comparator.

15. A reference voltage adjuster for generating modified reference voltages that are dependent upon the level of electrical signals received, comprising:

means for receiving a first series of electrical signals and a second series of electrical signals;

first means responsive to the receiving means for locating either a maximum signal value or a minimum signal value for the first series of electrical signals;

means responsive to the first locating means for determining the average of a new maximum or minimum signal and a previous maximum or minimum signal value for the first series of electrical signals;

second means responsive to the receiving means for locating either a maximum signal value or a minimum signal value for the second series of electrical signals; and means responsive to the second locating means for determining the average of a new maximum or minimum signal and a previous maximum or minimum signal value for the second series of electrical signals.

16. The reference voltage generator of claim 15, wherein the receiving means includes a multiplexer having inputs coupled to the first and second series of electrical signals, the multiplexer alternatively selecting signals between the first and second series of electrical signals.

17. The reference voltage generator of claim 15, wherein the first locating means includes:

a first latch coupled to the receiving means for storing a signal representing a present signal received from the first series of electrical signals;

a comparator having a first input coupled to the first series of electrical signals and a second input coupled to the first latch;

a second latch for storing a signal representing either a previous maximum signal value or a previous minimum signal value for the first series of electrical signals; and a controller responsive to an output from the comparator for determining the existence of a new maximum or minimum signal value for the first series of electrical signals.

18. The reference voltage generator of claim 17, wherein the comparator generates a signal which is representative of the present signal being "greater than", "less than" or "equal to" a signal of the first series of electrical signals that immediately precedes the present signal, and wherein the controller determines the existence of a new maximum or minimum signal value for the first series of electrical signals by recognizing the existence of one of the following patterns of three consecutive signals from the comparator for the first series of electrical signals: ("greater than", "greater than", "less than") or ("less than", "less than", "greater than").

19. The reference voltage generator of claim 17, wherein the means responsive to the first locating means for determining the average includes:

an adder having a first input coupled to the first latch and a second input coupled to the second latch for summing the values of the present signal and the signal representing either a previous maximum or minimum signal value for the first series of electrical signals;

a divider coupled to the adder for dividing the summed values and producing an output; and a third latch coupled to the divider for storing the output received from the divider which represents a modified reference voltage for the first series of electrical signals.

20. The reference voltage generator of claim 19, wherein the second locating means includes:

a first latch coupled to the receiving means for storing a signal representing a present signal received from the second series of electrical signals;

a second latch for storing a signal representing either a previous maximum signal value or a previous minimum signal value for the second series of electrical signals;

wherein the comparator further includes a third input coupled to the first latch of the second locating means, with the first input of the comparator coupled to the second series of electrical signals; and wherein the controller is responsive to an output from the comparator for determining the existence of a new maximum or minimum signal value for the second series of electrical signals.

21. The reference voltage generator of claim 20, wherein the means responsive to the second locating means for determining the average includes:

the adder having an input coupled to the first latch of the second locating means and another input coupled to the second latch of the second locating means for summing the values of the present signal and the signal representing either a previous maximum or minimum signal value for the second series of electrical signals; and a third latch coupled to the divider for storing the output received from the divider which represents a modified reference voltage for the second series of electrical signals.

* * * * *